US009074809B2

(12) United States Patent
Lee et al.

(10) Patent No.: US 9,074,809 B2
(45) Date of Patent: Jul. 7, 2015

(54) REFRIGERATOR

(71) Applicant: SAMSUNG ELECTRONICS CO., LTD., Suwon-si (KR)

(72) Inventors: Gang U Lee, Daejeon (KR); Jong Hoon Oh, Gwangju (KR); Hyo Sik Kang, Gwangju (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 0 days.

(21) Appl. No.: 13/693,375

(22) Filed: Dec. 4, 2012

(65) Prior Publication Data

US 2013/0147336 A1 Jun. 13, 2013

(30) Foreign Application Priority Data

Dec. 7, 2011 (KR) ..... 10-2011-0130420

(51) Int. Cl.

| | |
|---|---|
| ***A47B 49/00*** | (2006.01) |
| ***A47B 96/04*** | (2006.01) |
| ***F25D 23/02*** | (2006.01) |
| ***F25D 25/00*** | (2006.01) |
| ***E05D 7/04*** | (2006.01) |
| *E05D 7/00* | (2006.01) |
| *E05D 11/00* | (2006.01) |
| *E05F 1/12* | (2006.01) |
| *E05D 7/081* | (2006.01) |

(52) U.S. Cl.

CPC ..... *F25D 23/028* (2013.01); *F25D 25/00* (2013.01); *F25D 2323/0011* (2013.01); *F25D 2323/024* (2013.01); *E05D 7/0027* (2013.01); *E05D 7/0423* (2013.01); *E05D 11/00* (2013.01); *E05F 1/1207* (2013.01); *E05D 7/081* (2013.01); *E05Y 2600/626* (2013.01); *E05Y 2900/31* (2013.01)

(58) Field of Classification Search

CPC ... F25D 23/028; F25D 2323/024; E05D 7/08; E05Y 2900/31; A47B 91/16; A47B 91/024; A47B 91/02

USPC ..... 16/243, 244; 312/401, 405, 326

See application file for complete search history.

(56) References Cited

U.S. PATENT DOCUMENTS

| | | | | | |
|---|---|---|---|---|---|
| 2,499,277 | A | * | 2/1950 | Nalle | 16/19 |
| 2,828,578 | A | * | 4/1958 | McCabe | 248/188.4 |
| 4,070,728 | A | * | 1/1978 | Herman | 16/243 |
| 4,090,274 | A | * | 5/1978 | Bourgeois | 16/317 |
| 4,462,225 | A | * | 7/1984 | Noe | 68/3 R |

(Continued)

FOREIGN PATENT DOCUMENTS

| | | |
|---|---|---|
| KR | 10-0519600 | 9/2005 |
| KR | 10-2008-0050137 | 6/2008 |
| KR | 10-2008-0094778 | 10/2008 |

*Primary Examiner* — Daniel J Troy
*Assistant Examiner* — Kimberley S Wright
(74) *Attorney, Agent, or Firm* — Staas & Halsey LLP

(57) ABSTRACT

A refrigerator capable of adjusting the height of a body independent of the height of a door, in which a lower portion hinge connecting the body to the door includes a fixed bracket having one portion fixed to a bottom surface of the body while having the remaining portion protruded to a front side of the refrigerator, a mobile bracket coupled to the fixed bracket so as to enable a sliding movement and allowing the door to placed thereon, in which a body supporting leg and a door supporting leg are screwed to a lower portion of the fixed bracket and a lower portion of the mobile bracket, respectively, to adjust the respective heights of the fixed bracket and the mobile bracket.

21 Claims, 7 Drawing Sheets

(56) References Cited

U.S. PATENT DOCUMENTS

| | | | | | |
|---|---|---|---|---|---|
| 4,723,633 | A * | 2/1988 | Duncan | 182/230 |
| 4,932,729 | A * | 6/1990 | Thompson et al. | 312/405 |
| 5,046,790 | A * | 9/1991 | Onomoto et al. | 312/351.13 |
| 5,215,367 | A * | 6/1993 | Montuoro et al. | 312/401 |
| 5,697,586 | A * | 12/1997 | Lybarger | 248/188.4 |
| 5,788,351 | A * | 8/1998 | Prunty et al. | 312/326 |
| 5,971,350 | A * | 10/1999 | McCutcheon | 248/688 |
| 6,030,064 | A * | 2/2000 | Kim | 312/405 |
| 6,142,431 | A * | 11/2000 | Herzog | 248/188.4 |
| 6,910,665 | B2 * | 6/2005 | Avendano et al. | 248/188.2 |
| 7,325,412 | B2 * | 2/2008 | Yun et al. | 62/295 |
| 7,427,052 | B2 * | 9/2008 | Cha et al. | 248/188.8 |
| 7,490,384 | B2 * | 2/2009 | Lee | 16/244 |
| 7,556,227 | B2 * | 7/2009 | Thuelig | 248/188.8 |
| 7,685,678 | B2 * | 3/2010 | Moon et al. | 16/243 |
| 7,686,263 | B2 * | 3/2010 | Inoue | 248/188.2 |
| 7,744,050 | B2 * | 6/2010 | de Toledo et al. | 248/188.3 |
| 7,752,709 | B2 * | 7/2010 | Moon et al. | 16/244 |
| 7,866,614 | B2 * | 1/2011 | Erdmann et al. | 248/188.4 |
| 7,900,485 | B2 * | 3/2011 | Lee et al. | 68/3 R |
| 8,079,555 | B2 * | 12/2011 | Erdmann et al. | 248/188.4 |
| 8,166,611 | B2 * | 5/2012 | Moon | 16/240 |
| 8,166,612 | B2 * | 5/2012 | Bertolini et al. | 16/244 |
| 8,234,888 | B2 * | 8/2012 | Kim et al. | 68/13 R |
| 8,388,077 | B2 * | 3/2013 | Park | 312/405 |
| 8,444,238 | B2 * | 5/2013 | Choi | 312/405 |
| 8,485,492 | B2 * | 7/2013 | Justis | 248/677 |
| 8,511,636 | B2 * | 8/2013 | Kucuk et al. | 248/677 |
| 8,579,394 | B2 * | 11/2013 | Lee et al. | 312/405 |
| 2004/0178305 | A1 * | 9/2004 | Avendano et al. | 248/188.2 |
| 2006/0102815 | A1 * | 5/2006 | Erdmann et al. | 248/188.2 |
| 2006/0168760 | A1 * | 8/2006 | Espindola et al. | 16/374 |
| 2006/0244351 | A1 * | 11/2006 | Moon et al. | 312/405 |
| 2008/0201902 | A1 * | 8/2008 | Moon et al. | 16/244 |
| 2008/0203872 | A1 * | 8/2008 | Cho | 312/330.1 |
| 2009/0038117 | A1 * | 2/2009 | Moon | 16/240 |
| 2009/0145177 | A1 * | 6/2009 | Kim et al. | 68/13 R |
| 2009/0184614 | A1 * | 7/2009 | Walsberg | 312/351.3 |
| 2010/0218342 | A1 * | 9/2010 | Bertolini et al. | 16/244 |
| 2011/0001413 | A1 * | 1/2011 | Park | 312/405 |
| 2011/0017883 | A1 * | 1/2011 | Erdmann et al. | 248/188.4 |
| 2011/0148259 | A1 * | 6/2011 | Justis | 312/228 |
| 2012/0038259 | A1 * | 2/2012 | Lee et al. | 312/405 |
| 2012/0181912 | A1 * | 7/2012 | Cui et al. | 312/405 |
| 2013/0076222 | A1 * | 3/2013 | Lee et al. | 312/405 |
| 2013/0154464 | A1 * | 6/2013 | Fiori et al. | 312/405 |

* cited by examiner

REFRIGERATOR

CROSS-REFERENCE TO RELATED APPLICATIONS

This application claims the priority benefit of Korean Patent Application No. 10-2011-0130420, filed on Dec. 7, 2011 in the Korean Intellectual Property Office, the disclosure of which is incorporated herein by reference.

BACKGROUND

1. Field

The following description relates to a refrigerator configured to adjust the height of a body independent of the height of a door thereof, and prevent the deflection of a door thereof even when used for a long term period.

2. Description of the Related Art

In general, a refrigerator is an apparatus provided with a storage compartment therein to store foods and a cooling device to supply cool air to the storage compartment to keep food fresh. The storage compartment is provided in a form of having an open front side, and the open front side is open/closed by a door rotatively installed on the body of the refrigerator.

The door as such is rotatively coupled to the body by an upper portion hinge and a lower portion hinge of the refrigerator. However, the door may not be disposed at a precise height due to an error during an assembly process or an error during a manufacturing process. In the case as such, an operational malfunction of the door as well as a hindrance to aesthetic beauty of the refrigerator may develop.

Thus, a refrigerator configured to adjust the height of a door thereof is under development. An example of the refrigerator as such has been suggested in Korean patent publication No. 10-2008-0094778 and in Korean patent publication No. 10-2008-0050137.

According to the publications above, the door of a refrigerator is supported by a hinge bracket which is fixed to the body of the refrigerator, and a door rotation shaft is coupled to the hinge bracket so as to enable ascending/descending, so that the relative height of the door with respect to the body of the refrigerator may be adjusted by raising/lowering the door rotation shaft.

However, with reference to the refrigerator as such, in a case when the height of the body of the refrigerator with respect to the bottom surface is changed, the height of the door thereof is also needed to be changed with respect to the bottom surface. In addition, the weight of the door is applied to the hinge bracket, and thereby a deflection of the hinge bracket may occur.

SUMMARY

Therefore, it is an aspect of the present disclosure to provide a refrigerator configured to independently adjust the height of a body and a door thereof.

It is another aspect of the present disclosure to provide a lower portion hinge structure of a refrigerator capable of preventing the deformation such as a deflection even when used for a long term period.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment, a door, and a lower portion hinge. The storage compartment may be provided at an inside the body. The door may be provided at a front of the body to open/close a front surface of the storage compartment. The lower portion hinge may be installed at a lower portion of the body to rotatively support the door. The lower portion hinge may include a fixed bracket, a mobile bracket. The fixed bracket may have one portion thereof fixedly coupled to a bottom surface of the body while the other portion thereof protruded toward a front side of the body. Left/right and forward/backward movements except for up/down movements of the mobile bracket may be restrained by the fixed bracket, and the mobile bracket may include a door cam for the door to be placed thereon and a door rotation shaft that is inserted into a lower portion of the door. A body supporting leg configured to support a weight of the body may be screwed to a lower portion of the fixed bracket, and a door supporting leg configured to support a weight of the door may be screwed to a lower portion of the mobile bracket. A height of the body may be adjusted by rotating the body supporting leg, and a height of the door may be adjusted by rotating the door supporting leg, so that the height of the body is adjusted independent of the height of the door.

A vertical bracket protruded toward a lower side may be formed at the mobile bracket, and a vertical bracket accommodating portion into which the vertical bracket is inserted may be formed at the fixed bracket, so that left/right and forward/backward movements except for up/down movements of the mobile bracket may be restrained by the fixed bracket.

The vertical bracket and the mobile bracket are formed as an integral body.

The vertical bracket accommodating portion may be formed in a way that a width of left/right directions thereof is wider than a width of forward/backward directions thereof.

At least one guide protrusion may be formed at an upper side of the vertical bracket accommodating portion to guide the movement of the vertical bracket.

A first male screw portion may be formed at one of the fixed bracket and the body supporting leg, and a first female screw portion at which the first male screw portion is coupled may be formed at the remaining one of the fixed bracket and the body supporting leg.

A second male screw portion may be formed at one of the mobile bracket and the door supporting leg, and a second female screw portion at which the second male screw portion is coupled may be formed at the remaining one of the mobile bracket and the door supporting leg.

A door supporting shaft may be formed as the second male screw portion and the second female screw portion are coupled to each other by a screw, and the door supporting shaft may not be provided in collinear with the door rotation shaft.

The door supporting shaft may be provided at the inner side of the body when compared to the door rotation shaft.

A tool coupling portion may be provided on at least one of the body supporting leg and the door supporting leg so that a tool is coupled to the tool coupling portion to rotate the at least one of the body supporting leg and the door supporting leg.

The tool coupling portion may be provided in a form of a groove vertically elongated.

In accordance with another aspect of the present disclosure, a refrigerator a body, a storage compartment, a door and a lower portion hinge. The storage compartment may be provided at an inside the body. The door may be provided at a front of the body to open/close a front surface of the storage compartment. The lower portion hinge may be installed at a lower portion of the body to rotatively support the door. The lower portion hinge may include a fixed bracket and a mobile bracket. The fixed bracket may have one portion thereof fixedly coupled to a bottom surface of the body while the other portion thereof protruded toward a front side of the body. Left/right and forward/backward movements except for up/down movements of the mobile bracket may be restrained by the fixed bracket, and the mobile bracket may include a door cam for the door to be placed thereon and a door rotation shaft that is inserted into a lower portion of the door. The fixed bracket may be provided with a first leg coupling portion to which a body supporting leg configured to support a weight of the body is screwed so as to enable ascending/descending. The mobile bracket may be provided with a second leg coupling portion to which a door supporting leg configured to support a weight of the door is screwed so as to enable ascending/descending.

Each of the first leg coupling portion and the second leg coupling portion may be one of a male screw portion and a female screw portion.

In accordance with another aspect of the present disclosure, a refrigerator includes a body, a storage compartment, a door, a fixed bracket, a mobile bracket, a body supporting leg, and a door supporting leg. A storage compartment may be provided at an inside the body. The door may be provided at a front of the body to open/close a front surface of the storage compartment. The fixed bracket may have a base portion disposed at a bottom surface of the body so as to be fixed to the bottom surface of the body, and a front protrusion portion protruded from the base portion to a front side of the body. The front protrusion portion may have a vertical bracket accommodating portion formed thereon to restrain a movement of the door. The mobile bracket may be disposed at an upper side of the front protrusion portion of the fixed bracket while having a door cam at which the door is placed, a horizontal bracket provided with a door rotation shaft inserted into a lower portion of the door, and a vertical bracket vertically inserted in a sliding manner into the vertical bracket accommodating portion. The body supporting leg may be coupled to a lower portion of the fixed bracket by a screw to support a weight of the body and adjust a height of the body. The door supporting leg may be coupled to a lower portion of the mobile bracket by a screw to support a weight of the door and adjust a height of the door.

The door rotation shaft may be formed as an integral body with the horizontal bracket, and may be protruded toward an upper side of the horizontal bracket.

The door cam may be formed as a separate body from the horizontal bracket, and may be screwed and fixed to an upper side of the horizontal bracket.

The vertical bracket may be formed as an integral body with the horizontal bracket, and may be bent toward a lower side of the horizontal bracket.

As described above, the height of the door of a refrigerator and the height of the body of a refrigerator may be independently adjusted.

In addition, since each of the door and the body of a refrigerator is supported at the floor surface through a separate leg, the deflection of a hinge bracket may be prevented.

In addition, a tool coupling portion is formed at the outer circumferential surface of a door supporting leg, thereby able to easily rotate the door supporting leg.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
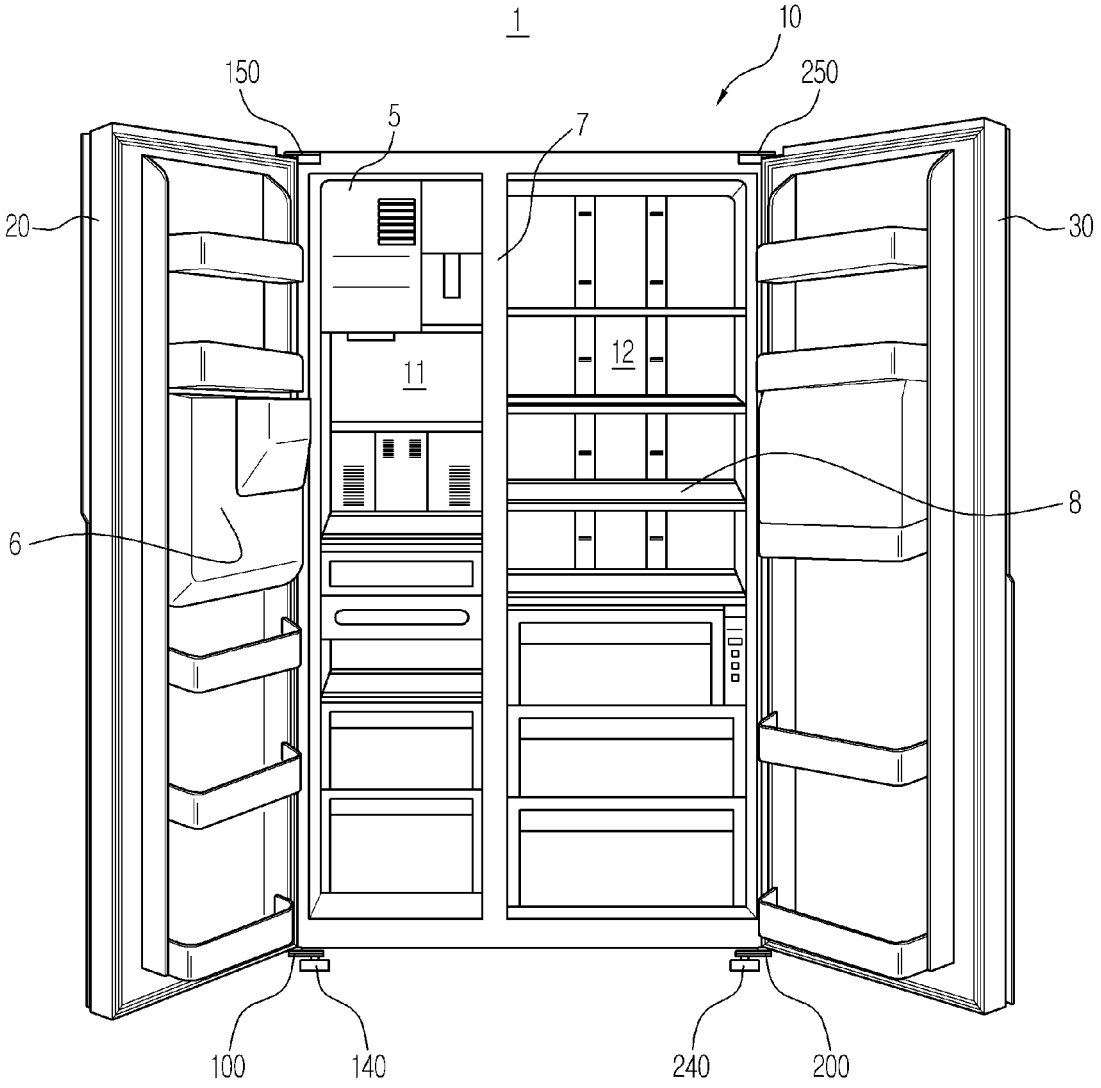
FIG. 1 is a drawing illustrating an exterior of a refrigerator in a state that the door of the refrigerator is open in accordance with an embodiment of the present disclosure.

Reference will now be made in detail to embodiments of the present disclosure, examples of which are illustrated in the accompanying drawings, wherein like reference numerals refer to like elements throughout.

Figure 2:
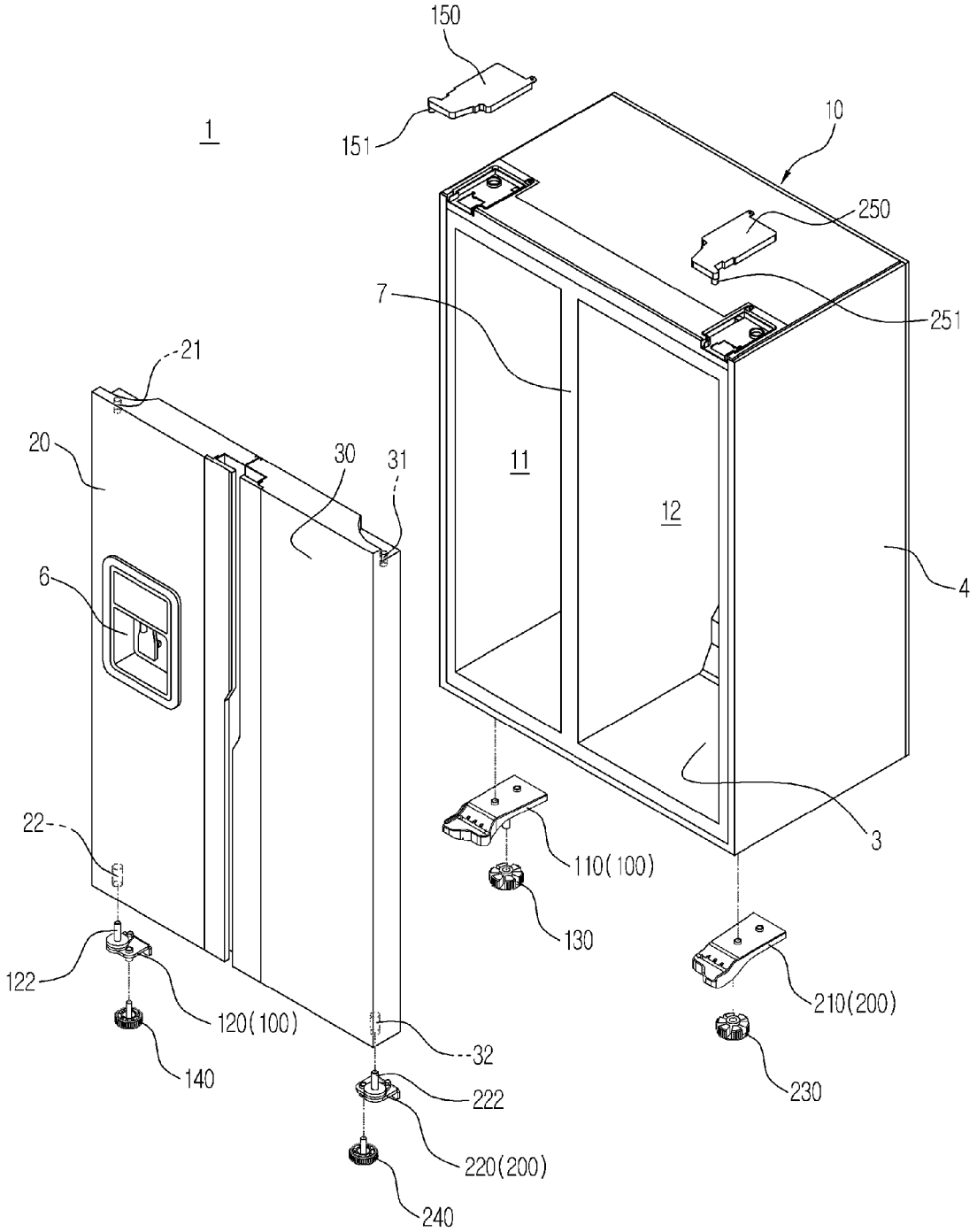
FIG. 2 is a perspective view illustrating a body separated from a door of the refrigerator of FIG. 1.

FIG. 1 is a drawing illustrating an exterior of a refrigerator in a state that the door of the refrigerator is open in accordance with an embodiment of the present disclosure. FIG. 2 is a perspective view illustrating a body separated from a door of the refrigerator of FIG. 1.

Referring to FIGS. 1 to 2, a refrigerator 1 according to an embodiment of the present disclosure includes a body 10, storage compartments 11 and 12 provided at the inside the body 10, doors 20 and 30 coupled to the body 10 to open/close the open front sides of the storage compartments 11 and 12, and a cooling apparatus (not shown) configured to supply cool air to the storage compartments 11 and 12.

The body 10 includes an inner case 3 to form the storage compartments 11 and 12, an outer case 4 to form an exterior while being coupled to an outer side of the inner case 3, and an insulation material (not shown) foamed between the inner case 3 and the outer case 4 to insulate the inside the storage compartments 11 and 12.

The storage compartments 11 and 12 may be used as a refrigerating compartment where foods are stored as refrigerated while the temperature therein is maintained between 0° C. to 5° C., or as a freezing compartment where foods are stored as frozen while the temperature therein is maintained at about −20° C. The storage compartments 11 and 12 are divided between each other by a middle portion 7.

The storage compartments 11 and 12 may be provided with a shelf 8 for the foods to be placed thereon, and the inside space of the storage compartments 11 and 12 may be divided into an upper space and a lower space by the shelf 8. In addition, the storage compartments 11 and 12 may be provided therein with an ice making apparatus 5 to make ice. The cooling apparatus may include a compressor, a condenser, an expansion apparatus, an evaporator, a draft fan, and a cooling duct. The vapor coolant that is compressed at high pressure and high temperature through the compressor is liquefied through the condenser, and the liquefied coolant passes through the expansion apparatus and changes to the low-temperature and low-pressure state that may easily be evaporated. The coolant is evaporated while going through the evaporator, the surrounding heat may be taken away.

The doors 20 and 30 are rotatively coupled to the body 10 and may open the open front surface of the storage compartments 11 and 12. A left door 20 may open/close a left storage compartment 11, and a right door 30 may open/close a right storage compartment 12. The left storage compartment 11 and the right storage compartment 12 may be different to each other in size, and accordingly, the left door 20 and the right door 30 may also be different to each other in size.

The doors 20 and 30 may be provided therein with a dispenser 6 through which water or ice may be taken out from the outside the refrigerator 1 without having to open the doors 20 and 30.

The doors 20 and 30 as such may be rotatively coupled to the body 10 by upper portion hinges 150 and 250 and lower portion hinges 100 and 200. A rotation shaft insertion groove 21 may be formed at the upper portion of the left door 20 so that a door rotation shaft 151 of the upper portion hinge 150 on the left side may be inserted into the rotation shaft insertion groove 21, and a rotation shaft insertion groove 22 may be formed at the lower portion of the left door 20 so that a door rotation shaft 122 of the lower portion hinge 100 on the left side may be inserted into the rotation shaft insertion groove 22.

Similarly, a rotation shaft insertion groove 31 may be formed at the upper portion of the right door 30 so that a door rotation shaft 251 of the upper portion hinge 250 on the right side may be inserted into the rotation shaft insertion groove 31, and a rotation shaft insertion groove 32 may be formed at the lower portion of the right door 30 so that a door rotation shaft 222 of the lower portion hinge 200 on the right side may be inserted into the rotation shaft insertion groove 32.

Therefore, the left door 20 may be rotated while having the door rotation shaft 151 and the door rotation shaft 122, which are formed by the upper portion hinge 150 on the left side and the lower portion hinge 100 on the left side, as a center of rotation, and the right door 30 may be rotated while having the door rotation shaft 251 and the door rotation shaft 222, which are formed by the upper portion hinge 250 on the right side and the lower portion hinge 200 on the right side, as a center of rotation.

The lower portion hinges 100 and 200 as such provide the axes for the doors 20 and 30 to rotate thereon, and configured to support the weight of the door 20 and the door 30 at the floor surface.

Meanwhile, as illustrated on FIG. 2, the lower portion hinges 100 and 200 of the refrigerator 1 according to an embodiment of the present disclosure may include fixed brackets 110 and 210 that are fixed to the bottom surface of the body 10 and mobile brackets 120 and 220 that are coupled to the fixed brackets 110 and 210 in a way that the mobile brackets 120 and 220 may ascend/descend.

In addition, body supporting legs 130 and 230 are coupled to the fixed brackets 110 and 210, and door supporting legs 140 and 240 that are separately provided from the body supporting legs 130 and 230 and may be coupled to the mobile brackets 120 and 220.

Therefore, the weight of the body 10 is supported at the floor surface through the body supporting legs 130 and 230, and the weight of the door 20 and the door 30 may be supported at the floor surface by the door supporting legs 140 and 240 separately from the body 10.

The structure of the lower portion hinges 100 and 200 as such will hereafter be explained in detail.

Figure 3:
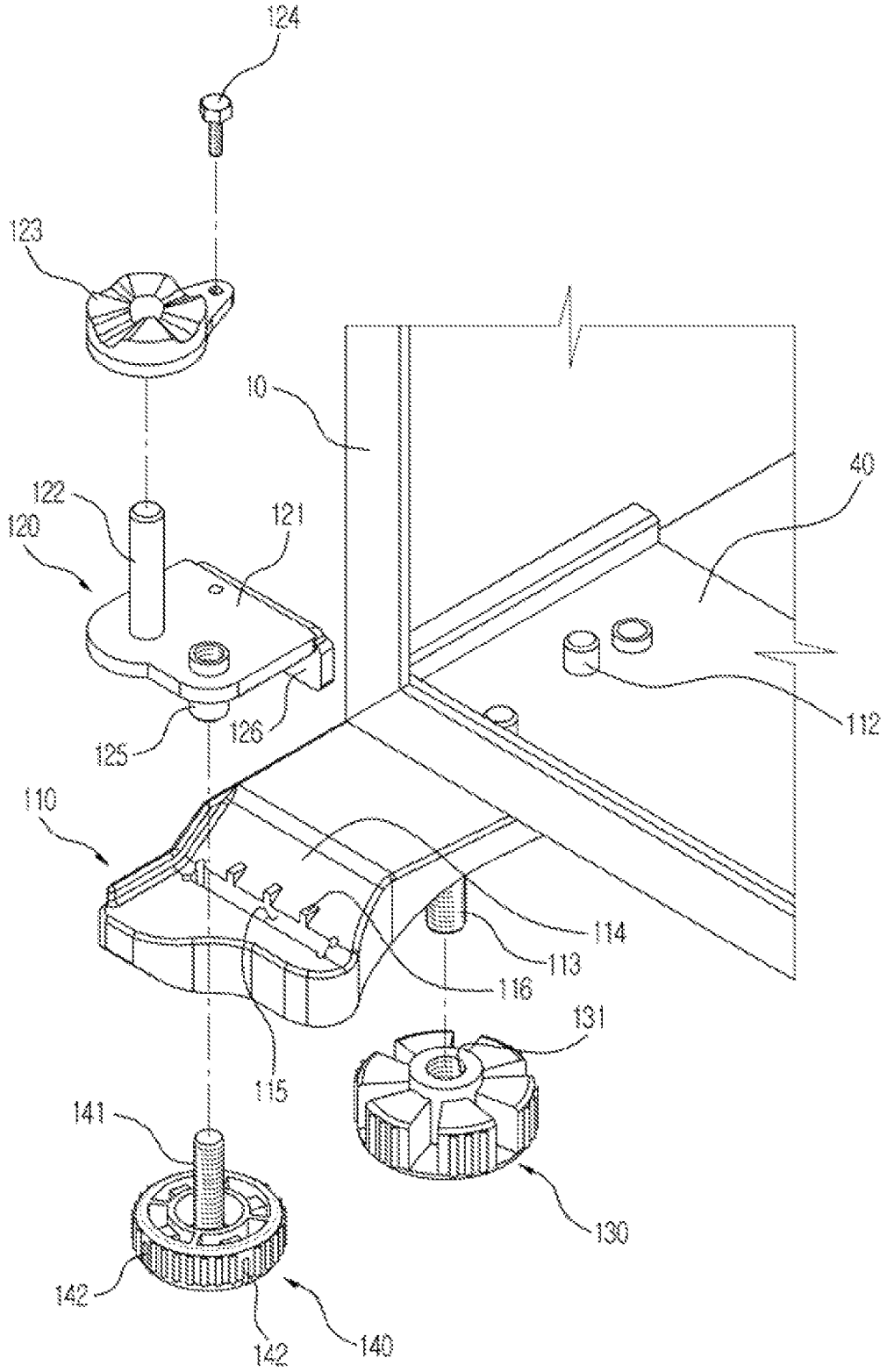
FIG. 3 is an exploded perspective view of a lower portion hinge of the refrigerator of FIG.
Figure 4:
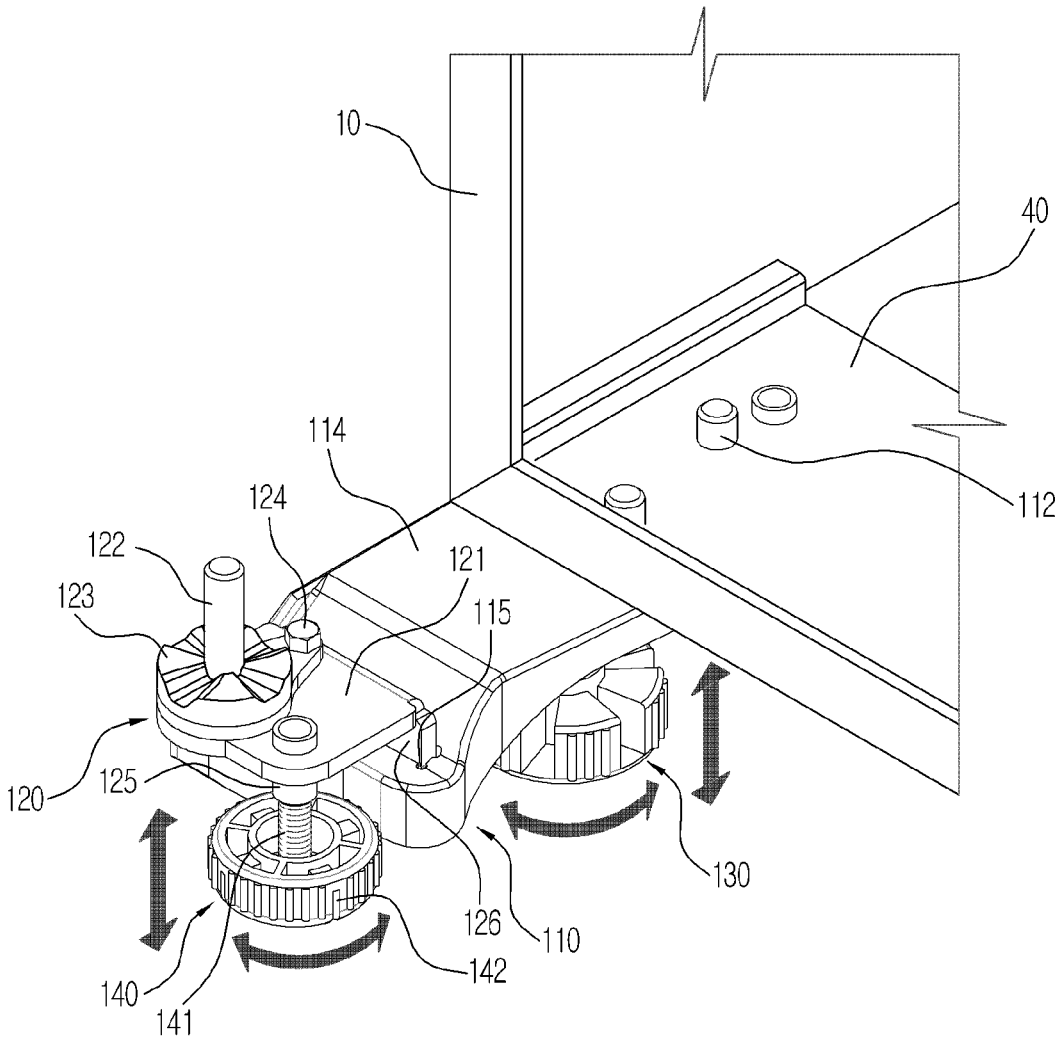
FIG. 4 is an assembled perspective view of a lower portion hinge of the refrigerator of FIG. 1.
Figure 5:
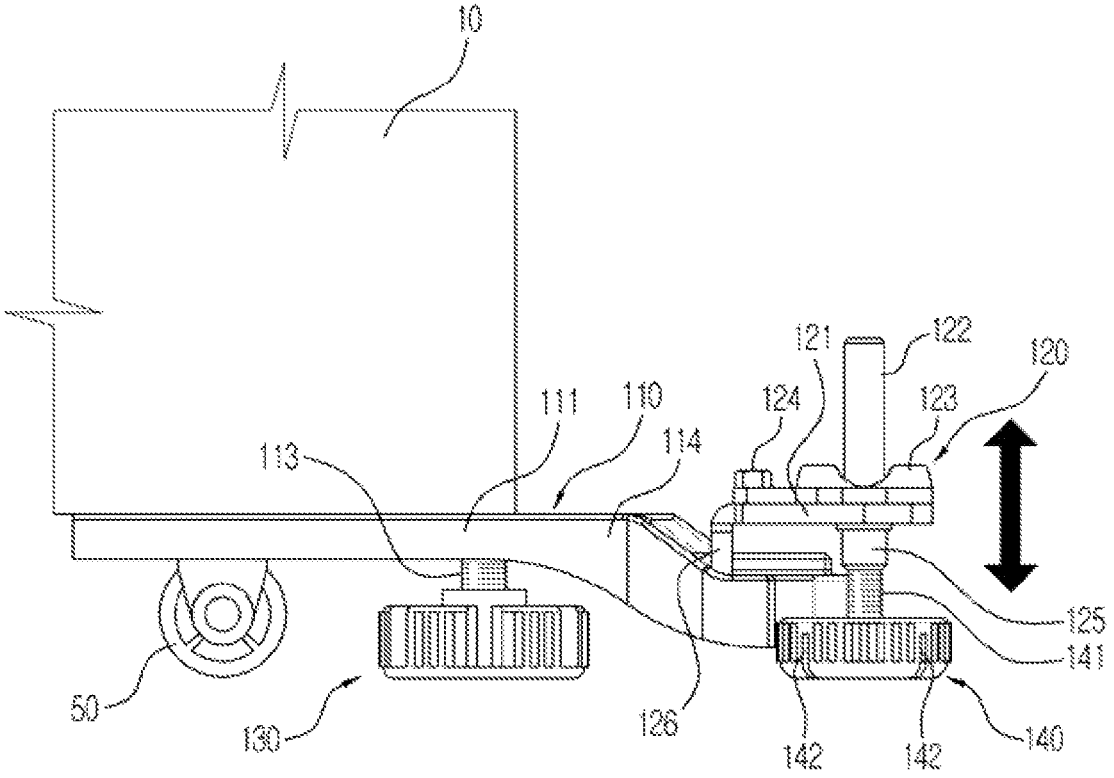
FIG. 5 is a side view of a lower portion hinge of the refrigerator of FIG. 1.
Figure 6:
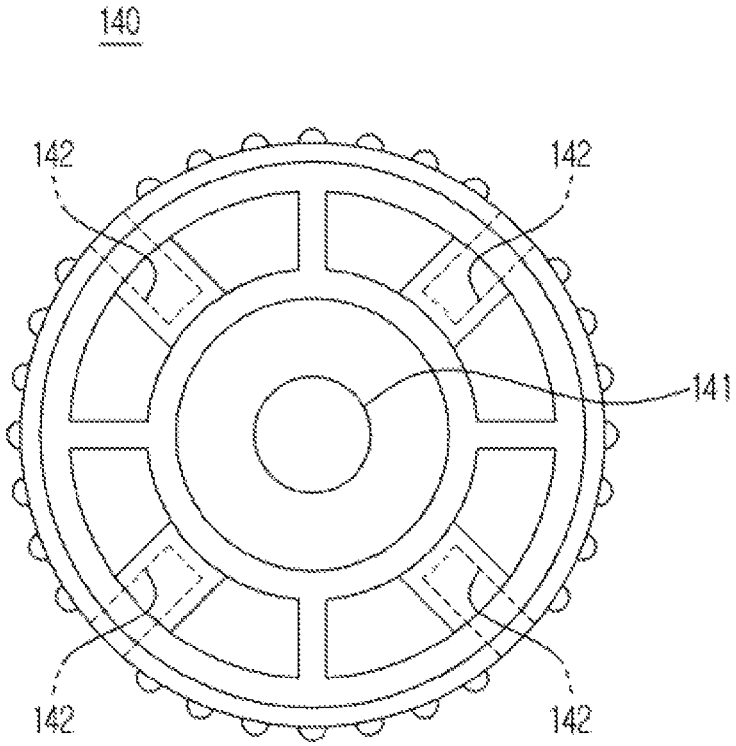
FIG. 6 is a plane view of a door supporting leg of the refrigerator of FIG. 1.
Figure 7:
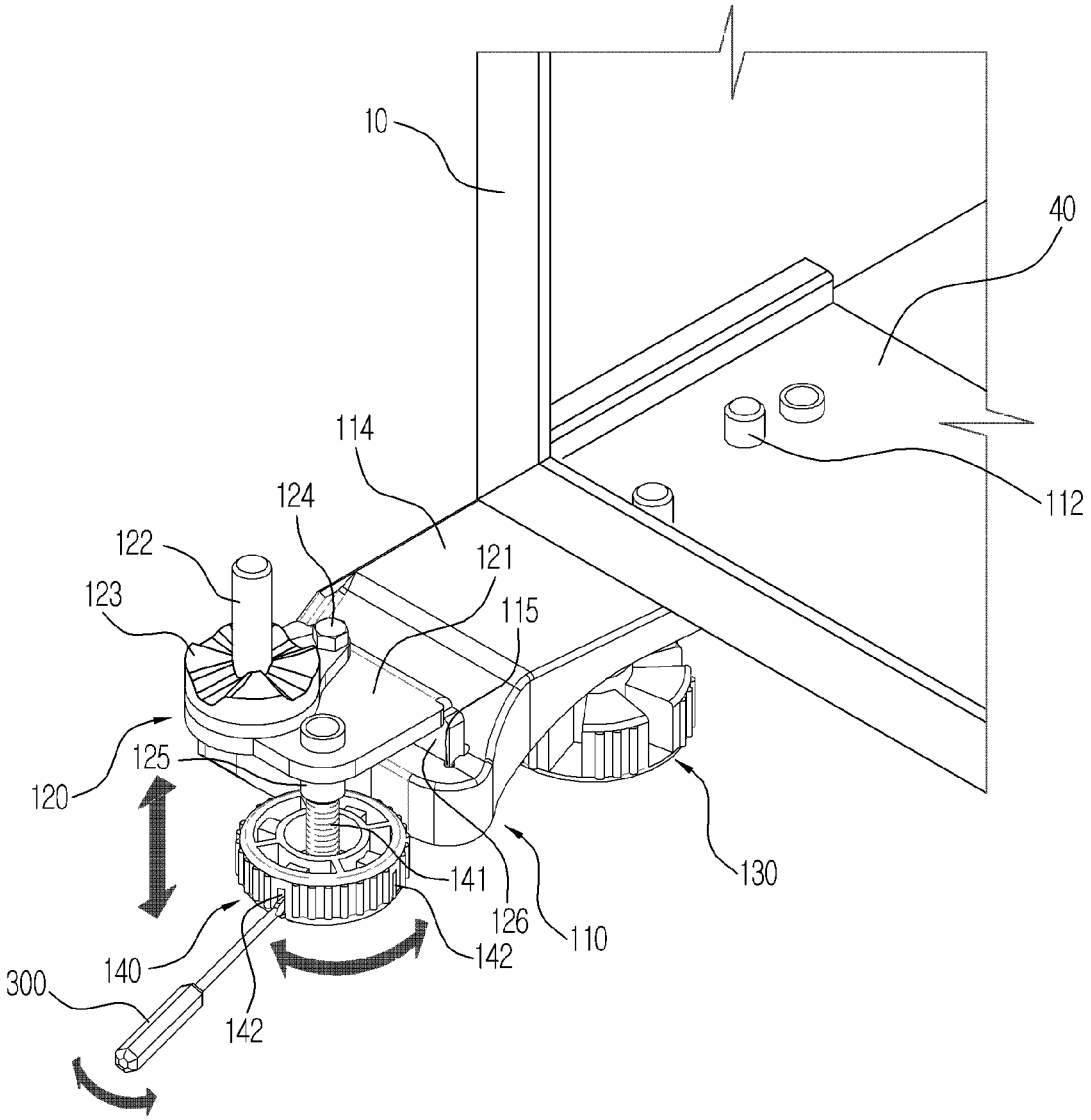
FIG. 7 is a drawing to explain the operation of ascending/descending a door supporting leg of the refrigerator of FIG. 1.

FIG. 3 is an exploded perspective view of a lower portion hinge of the refrigerator of FIG. 1. FIG. 4 is an assembled perspective view of a lower portion hinge of the refrigerator of FIG. 1. FIG. 5 is a side view of a lower portion hinge of the refrigerator of FIG. 1. FIG. 6 is a plane view of a door supporting leg of the refrigerator of FIG. 1. FIG. 7 is a drawing to explain the operation of ascending/descending a door supporting leg of the refrigerator of FIG. 1.

Hereafter, since the structure of the lower portion hinge 200 on the right side is identical to the structure of the lower portion hinge 100 on the left side, the structure of the lower portion hinge 100 on the left side will only be explained while the explanation on the structure of the lower portion hinge 200 on the right will be omitted.

By referring to the FIGS. 1 to 7, the lower portion hinge may include the fixed bracket 110 and the mobile bracket 120.

The fixed bracket 110 is provided while having a shape of an approximately elongated flat panel. One portion of the fixed bracket 110 is fixedly coupled to the bottom surface of the body 10, while the other remaining portion may be protruded toward the front of the body 10. Hereafter, the portion which is fixed to the bottom portion of the body 10 is referred to as a base portion 111 (FIG. 5), and the other remaining portion which is protruded toward the front from the base portion 111 is referred to as a front protrusion portion 114.

The base portion 111 may be firmly coupled to the bottom surface of the body 10 through a fastening screw 112, and at this time, a reinforcing panel 40 to reinforce the fastening strength may be coupled to the upper side of the bottom surface of the body 10.

A first male screw portion 113 having a screw thread on the outer circumferential surface thereof may be formed at the bottom portion of the base portion 111 of the fixed bracket 110 so that the body supporting leg 130 may be coupled by use of a screw to the bottom portion of the base portion 111 of the fixed bracket 110. A first female screw portion 131 having a screw thread on the inner circumferential surface thereof may be formed at the body supporting leg 130 so that the first female screw portion 131 may be coupled by use of a screw to the first male screw portion 131.

Although not illustrated, a female screw portion may be formed at the base portion 111, and a male screw portion may be formed at the body supporting leg 130. However, it is desired that the male screw portion or the female screw portion is provided with a sufficient length thereof to adjust the height of the base portion 111 of the fixed bracket 110 by tightening the screw or loosening the screw.

Here, since the base portion 111 of the fixed bracket 110 is fixed to the bottom surface of the body 10, the changing of the height of the base portion 111 of the fixed bracket 110 refers to the changing of the height of the body 10.

However, in order to adjust the height of the body 10 while maintaining the body 10 at level, the body supporting leg 230 on the right side and supporting legs on the rear left/right sides of the body 10 as well as the body supporting leg 130 on the left side are needed to be adjusted. Thus, the adjusting of the height of one of the lower portion hinges 100 and 200 of the door may be considered to adjusting the level state of the body 10.

The front protrusion portion 114 is a portion which is protruded toward the front of the body 10 for the door 20 to be supported. The front protrusion portion 114 is provided with a vertical bracket accommodating portion 115 formed therein, and the vertical bracket accommodating portion 115 is configured that a vertical bracket 126 may be inserted thereinto. The vertical bracket accommodating portion 115 will be explained later.

The fixed bracket 110 may be formed with various material, and as an example, the fixed bracket 110 may be manufactured through a die casting of the zinc material.

The mobile bracket 120 may support the door 20 as the door 20 is placed thereon, and is configured to be ascended or descended. The mobile bracket 120 may include a horizontal bracket 121 provided in a horizontal direction and a vertical bracket 126 extended from one end of the horizontal bracket 121 toward a lower side. The horizontal bracket 121 and the vertical bracket 126 may be integrally formed with each other, and may be provided with metallic material.

The horizontal bracket 121 is provided thereon with the door rotation shaft 122 that is inserted into the rotation shaft insertion groove 22 of the door 20 and is configured to form the rotation axis for the door 20. The door rotation shaft 122 is protruded toward the upper side of the horizontal bracket 121, and may be integrally formed with the horizontal bracket 121.

In addition, the horizontal bracket 121 is provided thereon with a door cam 123 configured to support the door 20 while the door 20 is effectively adhered thereto, and formed in a cam shape for the door 20 to be automatically open/closed. The door cam 123 may be provided with a separate compartment from the mobile bracket 120, and may be coupled to the upper surface of the horizontal bracket 121 by a fastening member 124.

In addition, the horizontal bracket 121 is provided thereon with a second female screw portion 125 having a screw thread at the inner circumferential surface thereof for the door supporting leg 140, which supports the weight of the door 20 at the floor surface, to be coupled to the horizontal bracket 121 by a screw. In response to such, a second male screw portion 141, which is inserted into and screwed to the second female screw portion 125, may be formed at the door supporting leg 140.

Although not illustrated, a male screw portion may be formed at the horizontal bracket 121, and a female screw portion may be formed at the door supporting leg 140. However, similar to the case of the fixed bracket 110 and the body supporting leg 130 which is previously explained, it is desired that the male screw portion or the female screw portion is provided with a sufficient length thereof to adjust the height of the mobile bracket 120 by tightening the screw or loosening the screw.

The second male screw portion 141 and the second female screw portion 125 may be coupled to each other and form a door supporting shaft to support a door. Here, the door supporting shafts are provided in collinear with the door rotation shaft 122.

That is, as illustrated on FIG. 4, the door supporting shafts, in order to support further the weight of the door 20 in a stable manner, may be formed at a nearer position to the inner side of the body 10 when compared to the door rotation shaft 122.

The vertical bracket 126 may be inserted into the vertical bracket accommodating portion 115 of the fixed bracket 110, which is previously explained, in a way that the vertical bracket 126 may be ascended or descended. That is, the vertical bracket 126 may be able to slide upward/downward at the vertical bracket accommodating portion 115. However, since the vertical bracket 126 and the vertical bracket accommodating portion 115 are provided with the shapes corresponding to each other, the vertical bracket 126 inserted into the vertical bracket accommodating portion 115 may only be able to move toward upward/downward directions in a sliding manner while not being able to move back/forth and left/right directions at the inside the vertical bracket accommodating portion 115.

Thus, the vertical bracket accommodating portion 115 is configured to restraint the back/forth and left/right direction movements of the vertical bracket 126 other than the upward/downward. More specifically, the mobile bracket 120 may only be able to move toward upward/downward directions with respect to the fixed bracket 110, not toward forward/backward or left/right directions. Furthermore, the door 20 which is supported by the mobile bracket 120 may only be able to move toward upward/downward directions, not toward forward/backward or left/right directions, with respect to the body 10.

In particular, by considering that the door 20 is applied with greater amount of strength to forward/backward directions while the door 20 is being open/closed, the vertical bracket accommodating portion 115 is desired to have a wider left-to-right width than a forward-to-backward width so that the forward/backward direction movements of the vertical bracket 126 may be stably restrained.

The shape of the vertical bracket 126 is not limited thereto where the vertical bracket 126 extends from one end of the horizontal bracket 121 to the lower side. The vertical bracket 126 may also be provided in a protrusion shape while simply protruded from one portion of the horizontal bracket 121 toward a bottom side. The vertical bracket 126 as such may be integrally formed with the horizontal bracket 121.

The vertical bracket accommodating portion 115 may be provided at the upper side thereof with at least one guide protrusion 116 to guide the vertical bracket 126 while the vertical bracket 126 is being inserted into the vertical bracket accommodating portion 115.

The guide protrusion 116, after the vertical bracket 126 is inserted into the vertical bracket accommodating portion 115, may support the vertical bracket 126 so that the mobile bracket 120 may further be restrained in a stable manner.

A tool coupling portion 142, which is configured for tools such as a flat head screw driver 300 to be coupled to, may be provided at the outer circumferential surface of the door supporting leg 140 for the door supporting leg 140 may be easily rotated.

The tool coupling portion 142 may be formed at the outer circumferential surface of the door supporting leg 140 in a form of a groove in upward/downward directions. The tool coupling portion 142 may be provided in at least one thereof along the circumferential direction of the door supporting leg 140, and as an example, as illustrated on FIG. 6, the total of four of the tool coupling portions 142 may be provided at an angle of 90° degrees.

Thus, as illustrated on FIG. 7, the door supporting leg 140 is rotated in a certain angle by coupling a tool at one of the tool coupling portions 142. Further, the door supporting leg 140 may be rotated manually by a user. After the door supporting leg 140 is rotated in a certain angle, a tool is coupled to the next adjacent tool coupling portion 142 to rotate the door supporting leg 140 again. By the method of rotating the door supporting leg 140 one after another, the door supporting leg 140 which is positioned close to the floor surface may be easily rotated.

Although not illustrated, the tool coupling portion 142 as such may also be provided at the body supporting leg 130, not only at the door supporting leg 140.

Meanwhile, as illustrated on FIG. 5, the refrigerator 1 according to the present disclosure may include a moving wheel 50, apart from the body supporting leg 130 and the door supporting leg 140, to move the refrigerator 1, and the moving wheel 50 may be coupled to the bottom portion of the fixed bracket 110.

The operation in adjusting the height of the door and the body of the refrigerator having the structure as such according to an embodiment of the present disclosure will be briefly explained.

As illustrated on FIG. 4, by rotating the body supporting leg 130, the height and the level of the body may be adjusted. At this time, since the mobile bracket 120 is irrelevant to the upward/downward movements of the fixed bracket 110 unless the mobile bracket 120 is descended to the position at which the mobile bracket 120 is closely adhered to the fixed bracket 110, the height of the door, is not changed even if the height of the body is adjusted.

In addition, by rotating the door supporting leg 140, the height of the door may be adjusted. At this time as well, since the fixed bracket 110 is irrelevant to the upward/downward movements of the mobile bracket 120, the height of the body remains unchanged even the height of the door is adjusted.

When the door supporting leg 140 is rotated, a tool such as a flat head screw driver 300 is coupled to the tool coupling portion 142 formed at the outer circumferential surface of the door supporting leg 140 to easily rotate the door supporting leg 140.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a storage compartment provided at an inside the body;

a door provided at a front of the body to open and close a front surface of the storage compartment; and a lower portion hinge installed at a lower portion of the body to rotatively support the door, wherein the lower portion hinge, comprises a fixed bracket having one portion thereof fixedly coupled to a bottom surface of the body while the other portion thereof protruded toward a front side of the body, and a mobile bracket, of which left, right, forward, and backward movements except for up and down movements are restrained by the fixed bracket, and which comprises a door cam for the door to be placed thereon and a door rotation shaft that is inserted into a lower portion of the door, wherein a body supporting leg configured to support a weight of the body is screwed to a lower portion of the fixed bracket, and a door supporting leg configured to support a weight of the door is screwed to a lower portion of the mobile bracket, wherein the weight of the body is supported at a floor surface by the body supporting leg, and the weight of the door is supported at the floor surface by the door supporting leg, and wherein a height of the body is adjusted by rotating the body supporting leg, and a height of the door is adjusted by rotating the door supporting leg, so that the height of the body is adjusted independent of the height of the door.

2. The refrigerator of claim 1, wherein a vertical bracket protruded toward a lower side is formed at the mobile bracket, and a vertical bracket accommodating portion into which the vertical bracket is inserted is formed at the fixed bracket, so that left, right, forward, and backward movements except for up and down movements of the mobile bracket are restrained by the fixed bracket.

3. The refrigerator of claim 2, wherein the vertical bracket and the mobile bracket are formed as an integral body.

4. The refrigerator of claim 2, wherein the vertical bracket accommodating portion is formed so that a width of left and right directions thereof is wider than a width of forward and backward directions thereof.

5. The refrigerator of claim 2, wherein at least one guide protrusion is formed at an upper side of the vertical bracket accommodating portion to guide the movement of the vertical bracket.

6. The refrigerator of claim 1, wherein a first male screw portion is formed at one of the fixed bracket and the body supporting leg, and a first female screw portion at which the first male screw portion is coupled is formed at the remaining one of the fixed bracket and the body supporting leg.

7. The refrigerator of claim 1, wherein a second male screw portion is formed at one of the mobile bracket and the door supporting leg, and a second female screw portion at which the second male screw portion is coupled is formed at the remaining one of the mobile bracket and the door supporting leg.

8. The refrigerator of claim 7, wherein a door supporting shaft is formed as the second male screw portion and the second female screw portion are coupled to each other by a screw, and the door supporting shaft is not provided in collinear with the door rotation shaft.

9. The refrigerator of claim 8, wherein the door supporting shaft is provided at the inner side of the body when compared to the door rotation shaft.

10. The refrigerator of claim 1, wherein a tool coupling portion is provided on at least one of the body supporting leg and the door supporting leg so that a tool is coupled to the tool coupling portion to rotate the at least one of the body supporting leg and the door supporting leg.

11. The refrigerator of claim 10, wherein the tool coupling portion is provided in a form of a groove vertically elongated.

12. A refrigerator, comprising:

a body;

a storage compartment provided at an inside the body;

a door provided at a front of the body to open and close a front surface of the storage compartment; and a lower portion hinge installed at a lower portion of the body to rotatively support the door, wherein the lower portion hinge, comprises a fixed bracket having one portion thereof fixedly coupled to a bottom surface of the body while the other portion thereof protruded toward a front side of the body, a mobile bracket, of which left, right, forward and backward movements except for up and down movements are restrained by the fixed bracket, and which comprises a door cam for the door to be placed thereon and a door rotation shaft that is inserted into a lower portion of the door, a vertical bracket formed at the mobile bracket, and a vertical bracket accommodating portion into which the vertical bracket is inserted formed at the fixed bracket, at least one guide protrusion being formed at an upper side of the vertical bracket accommodating portion to guide the movement of the vertical bracket, wherein the fixed bracket is provided with a first leg coupling portion to which a body supporting leg configured to support a weight of the body is screwed so as to enable ascending and descending, wherein the mobile bracket is provided with a second leg coupling portion to which a door supporting leg configured to support a weight of the door is screwed so as to enable ascending and descending, wherein the weight of the body is supported at a floor surface by the body supporting leg, and the weight of the door is supported at the floor surface by the door supporting leg, wherein the body supporting leg is configured to adjust a height of the body, and the door supporting leg is configured to adjust a height of the door, and wherein the height of the body is adjusted independent of the height of the door.

13. The refrigerator of claim 12, wherein each of the first leg coupling portion and the second leg coupling portion is one of a male screw portion and a female screw portion.

14. A refrigerator, comprising:

a body;

a storage compartment provided at an inside the body;

a door provided at a front of the body to open and close a front surface of the storage compartment;

a fixed bracket having a base portion disposed at a bottom surface of the body so as to be fixed to the bottom surface of the body, and a front protrusion portion protruded from the base portion to a front side of the body, the front protrusion portion having a vertical bracket accommodating portion formed thereon to restrain a movement of the door;

a mobile bracket disposed at an upper side of the front protrusion portion of the fixed bracket while having a door cam at which the door is placed, a horizontal bracket provided with a door rotation shaft inserted into a lower portion of the door, and a vertical bracket vertically inserted in a sliding manner into the vertical bracket accommodating portion;

a body supporting leg coupled to a lower portion of the fixed bracket by a screw to support a weight of the body and adjust a height of the body; and a door supporting leg coupled to a lower portion of the mobile bracket by a screw to support a weight of the door and adjust a height of the door, wherein at least one guide protrusion is formed at an upper side of the vertical bracket accommodating portion to guide the movement of the vertical bracket, wherein the weight of the body is supported at a floor surface by the body supporting leg, and the weight of the door is supported at the floor surface by the door supporting leg, wherein the body supporting leg is configured to adjust a height of the body, and the door supporting leg is configured to adjust a height of the door, and wherein the height of the body is adjusted independent of the height of the door.

15. The refrigerator of claim 14, wherein the door rotation shaft is formed as an integral body with the horizontal bracket, and is protruded toward an upper side of the horizontal bracket.

16. The refrigerator of claim 14, wherein the door cam is formed as a separate body from the horizontal bracket, and is screwed and fixed to an upper side of the horizontal bracket.

17. The refrigerator of claim 14, wherein the vertical bracket is formed as an integral body with the horizontal bracket, and is bent toward a lower side of the horizontal bracket.

18. The refrigerator of claim 12, wherein the door supporting shaft is provided at the inner side of the body when compared to the door rotation shaft.

19. The refrigerator of claim 14, wherein the door supporting shaft is provided at the inner side of the body when compared to the door rotation shaft.

20. The refrigerator of claim 7, wherein the second male screw portion formed at the door supporting leg is screwed to the second female screw portion which is formed through a portion of the mobile bracket.

21. The refrigerator of claim 1, wherein the fixed bracket has a shape of an approximately elongated flat panel.

* * * * *